US005411059A

United States Patent [19]

Sever et al.

[11] Patent Number: 5,411,059

[45] Date of Patent: May 2, 1995

[54] MULTIPLE FLOW RATE FLUID CONTROL VALVE ASSEMBLY

[75] Inventors: Robert E. Sever, Florissant; Randolph E. Scharfenberg, Manchester, both of Mo.

[73] Assignee: Essex Industries, Inc., St. Louis, Mo.

[21] Appl. No.: 189,909

[22] Filed: Feb. 1, 1994

[51] Int. Cl.[6] ..... A62B 9/02

[52] U.S. Cl. ..... 137/599; 128/205.24; 137/554; 137/613; 137/625.4; 251/206; 251/285; 251/288; 251/297; 251/280

[58] Field of Search ..... 128/205.24; 137/554, 137/599, 613, 625.4, 625.48; 251/206, 280, 285, 288, 297

[56] References Cited

U.S. PATENT DOCUMENTS

| | | | |
|---|---|---|---|
| 506,991 | 10/1893 | Forstburg et al. . | |
| 896,864 | 8/1908 | Spamer . | |
| 912,532 | 2/1909 | Brat . | |
| 1,243,219 | 10/1917 | Ralphs . | |
| 1,425,088 | 8/1922 | Hayes . | |
| 2,331,109 | 10/1943 | De Ganahl . | |
| 2,348,093 | 5/1944 | Pasman | 251/280 X |
| 2,752,944 | 7/1956 | Temple . | |
| 2,994,344 | 8/1961 | Kerley . | |
| 3,050,083 | 8/1962 | Verway | 137/625.4 X |
| 3,223,122 | 12/1965 | Banker | 137/625.4 |
| 3,367,365 | 2/1968 | Stevens | 137/554 |
| 3,602,245 | 8/1971 | Meisel . | |
| 3,799,080 | 3/1974 | Horn . | |
| 3,814,093 | 6/1974 | Gregory . | |
| 4,109,828 | 8/1978 | Stewart . | |
| 4,219,532 | 8/1980 | Messervey | 137/625.48 X |
| 4,406,303 | 9/1983 | Kilmoyer . | |
| 4,449,524 | 5/1984 | Gray | 128/205.24 X |
| 4,572,477 | 2/1986 | Phlipot et al. . | |
| 4,643,215 | 2/1987 | Phlipot et al. . | |
| 4,655,246 | 4/1987 | Phlipot et al. . | |
| 4,798,223 | 1/1989 | Mitchell et al. . | |
| 4,901,976 | 2/1990 | Smith | 251/206 |

*Primary Examiner*—Robert G. Nilson
*Attorney, Agent, or Firm*—Kalish & Gilster

[57] ABSTRACT

A multiple flow rate fluid control valve assembly in which the mode of fluid flow is interfaced with the rate of fluid flow has a mode control valve having a switch for selectively setting the valve to either of a continuous fluid flow mode or a pulse fluid flow mode. A fluid flow rate control valve is connected to the mode control valve for selectively controlling the rate of fluid flow from a source of fluid through the rate control valve to the mode control valve, to thereby provide fluid from the source of fluid to the mode control valve at a rate which is appropriate for the mode of fluid delivery and the particular fluid use.

23 Claims, 8 Drawing Sheets

MULTIPLE FLOW RATE FLUID CONTROL VALVE ASSEMBLY

BACKGROUND AND SUMMARY OF THE INVENTION

The present invention relates generally to the field of fluid flow rate control mechanisms, and, more specifically, to an assembly or system of interconnected, interfacing valves for provision of fluid in either a constant or pulsed flow mode, and at multiple selectable rates with precise regulation thereof in either mode.

The new fluid valve assembly or system includes valve means developed especially for metering the flow of oxygen to a patient. However, the new assembly can also be used to meter fluids other than gaseous oxygen to a patient or some known device. For medical purposes, it is necessary to provide patient gases at very precise levels in a controlled manner, and ideally by means which are easily portable.

The new system is ordinarily used in conjunction with a pressurized source of liquid oxygen which is usually provided at either 20 psig or 50 psig. As the pressurized liquid oxygen comes out of an insulated bottle or other container it evaporates into a gas. The fluid flow rate control valve of the new system accepts the gaseous oxygen phase from either of the standard 20 psig or 50 psig sources, as may be convenient for the particular user, after passage of the fluid through a heat exchanger in the usual manner. The system may also be used with fluid sources having pressures other than those specified above as standard. For example, even pressures as low as 5 psig or as high as 100 psig could be used with the new assembly.

The pressurized gas (in this example, oxygen) goes through an orifice, a very small, finely calibrated hole, which meters out distinct fluid flow rates to the patient. The new valve has two distinct sets of such holes, one for supplying oxygen to a patient on a continuous basis and one for providing relatively larger volumes of oxygen in a short time span, so as to be "pulsed". Ordinarily doctors prescribe oxygen to patients at a constant rate of so many liters per minute, for example, anywhere in the range of from about 0.25 to about 15 liters per minute to a patient. As the doctor prescribes a certain dosage of oxygen to a patient, the flow control valve of the new system allows the patient to select the prescribed flow mode of oxygen delivery.

There is also another means of administering oxygen other than a standard constant flow. The alternate mode is to "pulse" out a dose of oxygen, the same volume the patient would normally breath in over the space of an entire inhalation, except that it is suddenly dosed out in one large volume on the initiation of inhalation by the patient, because the patient only receives oxygen during active inhalation. When the patient exhales and the oxygen administration system is in a continuous flow mode, oxygen is wasted. Thus, the intent is to deliver oxygen to a patient only upon inhalation demand as indicated by an electronically sensed pressure drop. Thus, by pulse delivering intermittent large volumes, approximately one third less than the normal amount of oxygen is used, the net result being an oxygen system weight reduction, a cost reduction (less total oxygen used), and a gain in patient mobility by provision of the patient with a smaller package.

In the pulsing mode it is often desired to administer in a shorter time span an amount of oxygen which is the equivalent of approximately 16cc of oxygen per one liter of total fluid per minute of fluid flow. The rate control valve of the new valve assembly provides at least two groups of graduated orifices to permit oxygen dose metering. The holes in the second group of orifices in the flow control valve are designed to meter out a uniform volume of oxygen over a short time span, i.e., to "pulse" out the flow intermittently upon demand which is signalled by a pressure drop caused by inhalation. This time period is normally about 0.4 of a second, so that when the patient inhales, immediately, within approximately the first 0.4 seconds of the inhalation, a volume of oxygen that is equivalent to 16 cc of oxygen per liter of fluid, as normally prescribed, is pulsed out through the system. Thus the new rate control valve permits the assembly to deliver patient oxygen much more efficiently than was previously known.

The flow rate control valve of the new valve assembly has two at least two different sets of orifices. One is for continuous flow to the patient and the other for pulsing flow, as mentioned. The pulsing flow necessarily has a larger range of hole sizes because a larger volume must be provided in one dose.

In order for the patient or doctor to choose between the pulsing mode and the continuous flow it is also necessary to have a valve that toggles or otherwise is switchable between either one or the other of the two flow modes. Thus, the new fluid valving assembly also includes a mode selector valve allows us to choose which flow type the patient will receive. If the patient is on continuous flow, the administrator just opens up the holes and allows flow going directly to the patient. If, however, the patient is to receive oxygen in the pulsed mode, fluid outlet and inlet ports that admit larger volumes and meter out the pulsed flow to the patient are selected.

The new fluid flow mode control valve permits a choice between either the smaller or larger port and has incorporated an electrical switch that sends a signal to a circuit board to indicate that the valve is in the pulse mode, and thereby directs a solenoid valve to open up and pulse out the metered flow of oxygen. The circuit board and the solenoid valve are provided from and function according to commonly available technology. The new valve system provides a means of delivering oxygen in either fixed (continuous) flow or pulsing flow and a means of turning on and off the electronic signalling device as will be clear from the following description.

One major purpose of the new system is to provide an improved apparatus for supplying prescribed oxygen to a patient, as discussed. However, the new fluid flow control valve assembly provides such a wide range of controlled fluid transfer options that it can also be well utilized in many other areas, for example,laboratory research, and industrial research and applications, such as the automotive industry. Furthermore, particular fluids which are foreseen to be used in the new system include nitrogen, helium, argon, etc.

The new valve system can also conceivably be used in a reverse flow mode to mix different fluids, such as oxygen and acetylene, in very precise proportions to achieve a fluid mixture of exactly controlled content, for a similarly wide variety of possible uses.

Previously, fluid control valves have been known for many uses. However, for a variety of reasons these known valves have been unsuitable for provision of medical grade oxygen to a patient. Some valves are intended only for uses requiring very high volumes, and thus cannot be miniaturized so as to be easily portable, especially when combined with other necessary equipment. Those and other known valves are not capable of fine calibration for the precise amount of fluid to be delivered, nor can the mode of delivery (constant or pulsed) be selectively altered as required for a particular application.

Also, many other known valves do not include fail-safe features which ensure that the fluid flow through the valve or valve assembly will always be available, regardless of mode switch position. Of course, in the case of a patient requiring supplemental oxygen it can be critical to the patient's life that the oxygen supply never be eliminated. It is also necessary that patient oxygen be precisely controlled in order to neither "starve" or "burn" the patient.

The known valve art does not suggest a patient oxygen system including a valve with multiple fluid flow rates and alternate flow modes, nor a fluid control valve configuration where the rate control valve body is provided with multiple outlet orifices which are integrated with multiple valve flow rate settings. Also, no system is known in which the same valve assembly design can be used selectively for either multiple flow modes or a single flow mode, the rate control valve configuration predetermining which track of apertures in a flow control plate is used.

This is particularly the case when considered with the feature of the flow control plate being a wafer-thin metal (eg. stainless steel) plate formed with circular tracks of tiny apertures of graduated size to control the flow rate, in such manner as to provide extremely high accuracy of the type required for oxygen administration ranging from pediatric levels up through emergency volumes. Further detailed discussion of such flow plates may be found in U.S. Pat. Nos. 4,572,477 and 4,643,215, which are incorporated herein by reference. In the flow rate control valve of the new assembly multiple sets or tracks of apertures or through-holes are provided so that it would be possible to have even three different flow rate levels, such as pediatric (lowest volume per unit time), normal (middle volume per unit time), and emergency (highest volume per unit time).

Thus, the new system can provide different flow control modes to permit calibrated oxygen flow either continuously, or as a pulsed oxygen supply system in which flow is provided on a pressure-demand basis by pressure-drop sensing by a control unit. Dual outlets, one for low volume constant-flow and the other for a pulsed flow at a rate which is variably from about two to about six times higher volume, based upon pressure-demand.

The multiple flow rate valve of the new system provides accurately calibrated flow regardless of whether there is system transition from one flow mode to the other, as in a portable oxygen system wherein a solenoid valve controls demand flow, but structure exists for switching to constant-volume flow if desired or necessary, such as in the event of a power failure, during which the automatic pressure sensor would not function (unless battery supplemented).

The known art also does not include patient oxygen or other fluid supply systems which feature a spool-valve design which is fail-safe in that fluid will continue to be supplied regardless of the switch position. The new valve spool design allows for both a low volume flow and a higher volume flow without flow-blocking elements or other compromises of patient safety. Moreover, the extremely compact design of the new flow mode selector valve incorporates a microswitch which is directly connected to the body of the unit for constant automatic electrical sensing of the flow mode position of the valve and reporting to a flow mode and pressure-sensing control circuit.

The flow mode valve portion of the new assembly is designed to provide for selectively toggled switching between constant flow mode and pressure demand flow mode control of gases in a pulsed oxygen supply system wherein oxygen is supplied on a pressure-demand basis by pressure drop sensing in the control unit. This switchable valve is formed with a spool-like shaft and includes a fluid outlet port which is positioned relative to sealing O-rings and is dimensioned relative to the O-ring longitudinal extent such that it will never be blocked, regardless of whether the valve shaft upon which the O-rings are mounted is toggled to one flow control position or the other, or even inadvertently somewhere intermediate (e.g. because toggling was incomplete). In this manner the unit is fail-safe, in that fluid will continue to be supplied no matter which switch position it is in, and the spool shaft design allows for both a low volume flow and a higher volume flow without flow-blocking elements.

Accordingly, it is among the several objects of the invention to provide an assembly of valves for provision of fluids in a manner in which the flow rate is highly controlled and amenable to precise calibration at both relatively high and low rates of flow, as well as being capable of use in either a continuous or pulsed flow manner. It is desired that the new system be especially suitable for use in supplying oxygen to patients, which may be children as well as adults, and in emergency situations as well as for long-term care.

It is further among the objects of the invention, having the features mentioned, to provide a fail-safe feature to ensure that regardless of the position of the mode control valve switch, fluid can always be passed through the "three-way" mode control valve and also that such valve be miniaturized for convenience of use and that it be provided with an electric switch for automatic sensing of the valve setting, whether for pulsed or continuous flow.

It is also among the several objects of the invention to provide an assembly having the features enumerated in which the various valving features can be provided either by a plurality of independent valves which are indirectly interconnected, or alternatively, by such valves in a combined construction, so directly connected that they essentially form a single unit which performs combined valving functions.

It is still further among the several objects of the invention that the new valve assembly or system provide metered delivery of fluid therethrough in an economical, fluid-conserving manner, so as to prevent inadvertent exhaustion of fluid supplies, and that the valve system components be suitable for manufacture from a variety of materials so as to amenable to various use requirements and economic and manufacturing constraints.

Thus, in furtherance of the above objects, the invention is, briefly, a multiple flow rate fluid control valve assembly in which the mode of fluid flow is interfaced with the rate of fluid flow. The assembly includes a first valve having a switch for selectively setting the valve to one of a plurality of selectable fluid flow modes. A second valve is connected to the first valve for selectively controlling the rate of fluid flow from a source of fluid through the second valve to the first valve, to thereby provide fluid from the source of fluid to the first valve at a rate which is appropriate for the mode of fluid delivery and the particular fluid use.

Also with regard to the new assembly, briefly, the shaft has a depression formed therein, and the first valve further includes a sensor for automatically sensing the flow mode in which the first valve is set. The sensor contacts the shaft at a point immediately adjacent the depression when the shaft is in one flow mode position and is removed from contact with the shaft when the first valve is switched to be in the other flow mode position due to longitudinal movement of the shaft within the bore until the depression formed in the shaft comes into alignment with the sensor.

The invention is also, briefly, the assembly just described, wherein the second valve is a flow rate control valve having an upper body portion and a lower body portion connected to the upper body portion. A flow control plate is rotatably mounted between the upper body portion and the lower body portion. The flow control plate has a plurality of tracks of apertures of graduated size for selectively controlling the amount of fluid which can pass therethrough as the fluid is transferred from the second valve to the first valve.

Furthermore, the plurality of tracks of apertures are formed as concentric rings of apertures of graduated size, the apertures of the outermost ring having diameters over a range which is greater than the diameter of any of the apertures in an innermost ring.

The invention is further, briefly, the assembly above, wherein the flow control plate is adapted for selective use of the second valve to provide fluid to the first valve at a predetermined flow rate which can be precisely controlled whether the first valve is in a continuous or a pulsed flow mode.

The invention is also, briefly, a fluid flow mode control valve for use as part of an assembly of valves for provision of fluid in a preselected delivery mode and at a preselected rate. The fluid mode control valve includes a valve body defining at least two inlet openings for receiving fluid from a fluid source at different preselected rates, which rates are preselected depending in part upon the preselected delivery mode, an outlet opening for release of fluid in the preselected delivery mode, and a throughbore in communication with each of the at least two inlet openings and in communication with the outlet opening. A shaft is slidably disposed within the through-bore, and a switch is connected to the shaft for selective moving of the shaft within the through-bore to cause a change in which of the at least two inlet openings is in communication with the outlet opening, to thereby selectively change the mode of fluid delivery through the flow mode control valve.

Other objects will be in part apparent and in part pointed out hereinbelow.

BRIEF DESCRIPTION OF THE DRAWINGS

Throughout the drawings like parts are indicated by like element numbers.

DESCRIPTION OF PRACTICAL EMBODIMENTS

Figure 1:
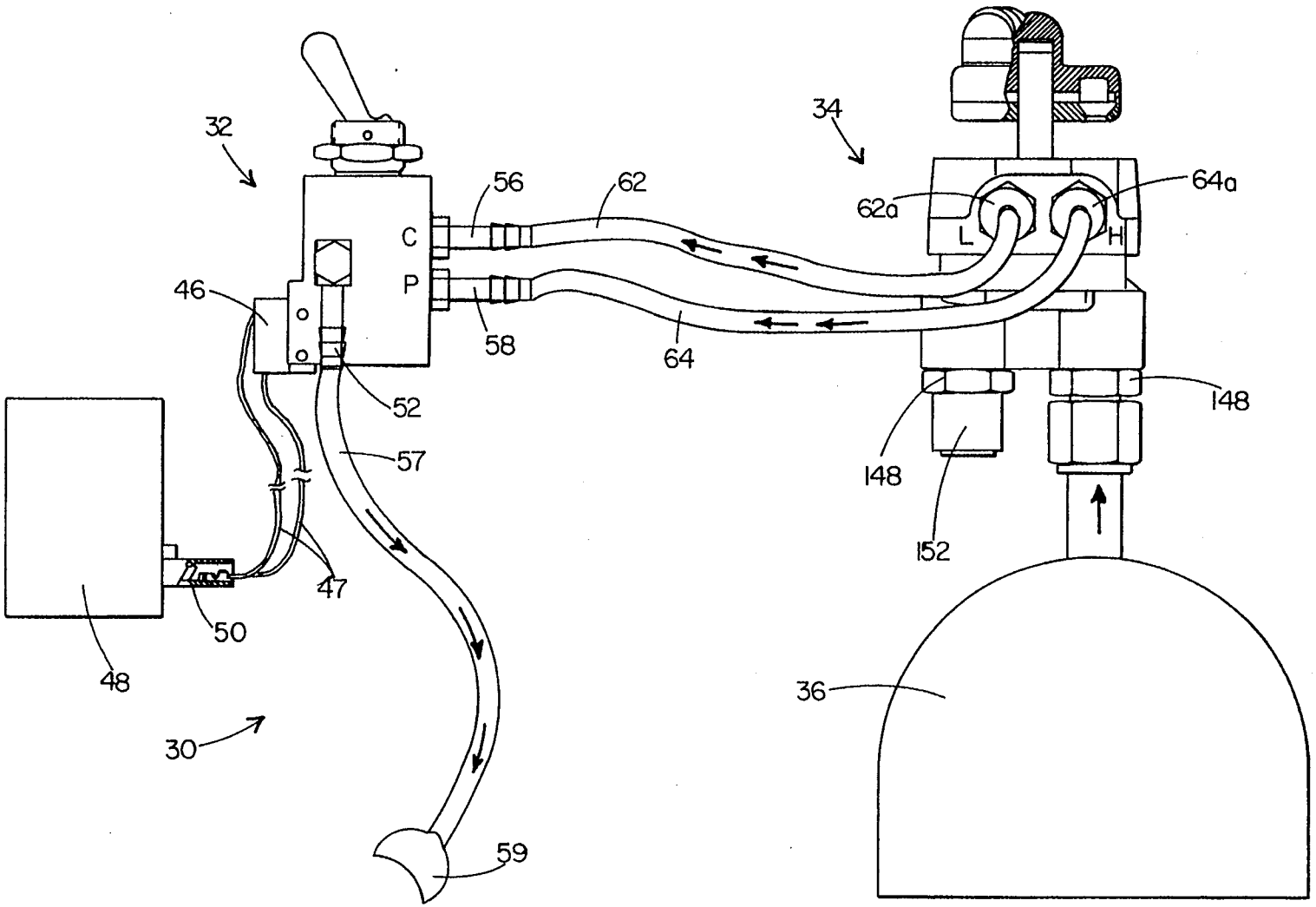
FIG. 1 is a schematic illustration of a multiple flow rate fluid control valve assembly constructed in accordance with and embodying the present invention.

With reference to the drawings, FIG. 1 schematically illustrates an example of use of the preferred form of the invention, wherein 30 generally designates a multiple flow rate fluid control valve assembly constructed in accordance with the invention. Although assembly 30 is suitable for a wide variety of uses, for convenience of this discussion, new fluid valve assembly 30 will be described for the most part in relation to a patient oxygen system which would ordinarily be arranged for the patient's convenience, such as by being enclosed in a package or case of known variety (not shown) for portability. It is understood, particularly in view of the above discussion, that the invention is not to be considered to be limited to such use, but that it is provided only as one especially desirable example.

As seen in FIG. 1, assembly 30 is generally composed of a "three-way" flow mode control valve 32 used in conjunction with a multiple flow rate control valve 34 to provide a patient, not shown, with metered oxygen from a pressurized source 36 in a precisely controlled, highly calibrated manner in either of continuous or pulse flow modes, the particular mode for use being selectively controlled by flow operation of flow mode control valve 32. Details of mode control valve 32 are described hereafter, especially with reference to FIGS. 2 through 10.

The Flow Mode Control Valve

Figure 5:
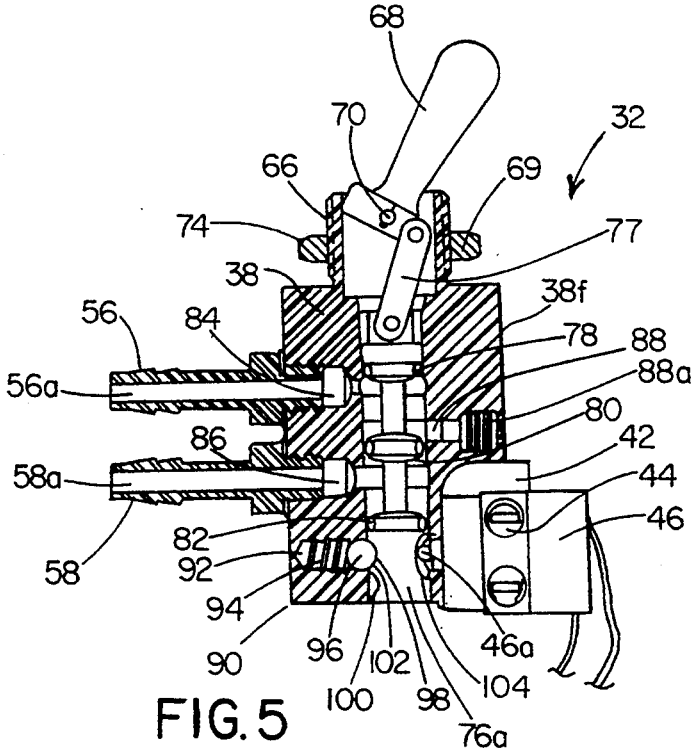
FIG. 5 is a partial vertical sectional view taken on line 5—5 of FIG. 2.
Figure 10:
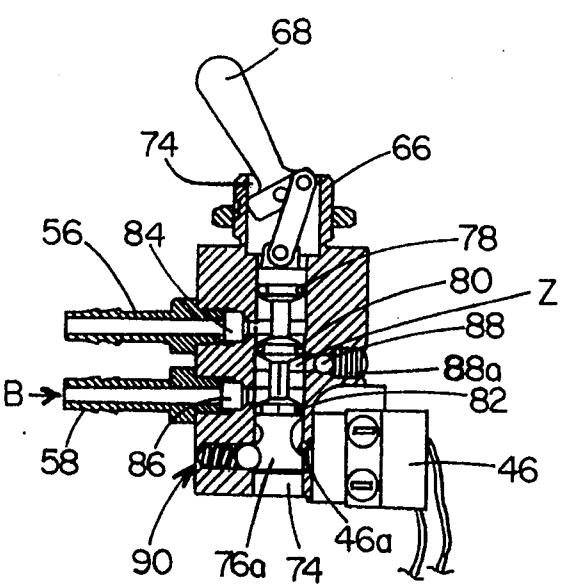
FIG. 10 is a partial vertical sectional view of the valve of FIG. 2, in the pulse flow mode position.
Figure 9:
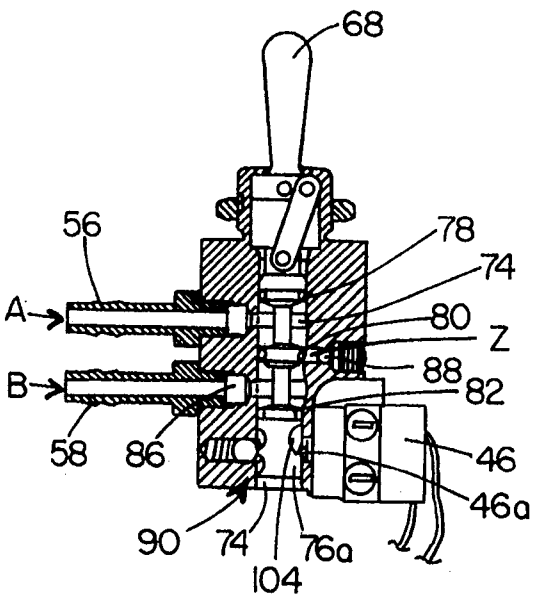
FIG. 9 is a partial vertical sectional view of the valve of FIG. 2, in the neutral, or "fail-safe", position.
Figure 8:
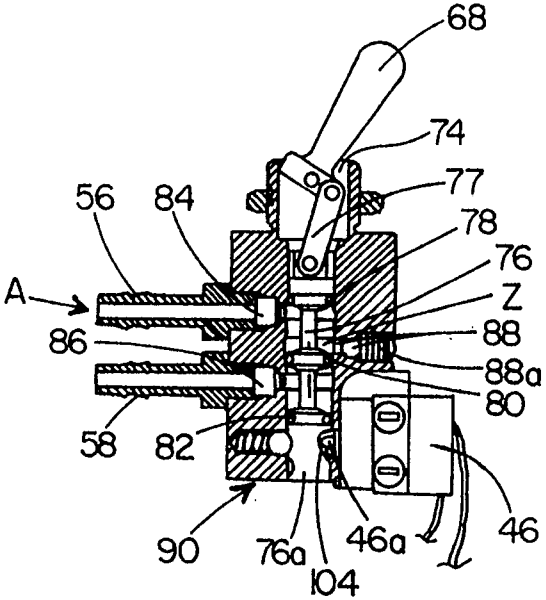
FIG. 8 is a partial vertical sectional view of the valve of FIG. 2, in the continuous flow mode position.
Figure 11:
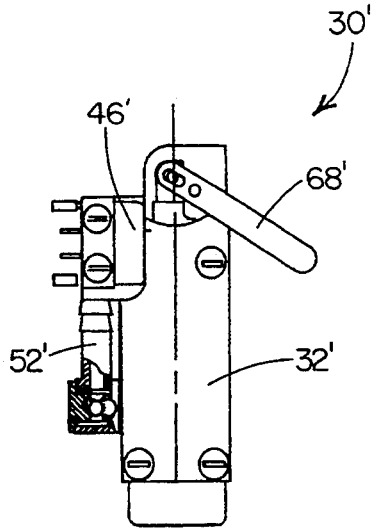
FIG. 11 is an elevational view of another embodiment of the valve of FIG. 2, showing the switch in one of the continuous or pulse flow mode positions.

Flow mode control valve 32 has a generally block-shaped body 38 defined by top wall 38*a*, bottom wall 38*b*, front wall 38*c*, back wall 38*d*, right end wall 38*e* and left end wall 38*f*, all directions being with reference to the position depicted in FIG. 1. Body 38 of valve 32 is substantially smaller than most valves previously used in patient oxygen systems, preferably measuring approximately 1.25 in. by approximately 0.75 to 1.0 in., by approximately 0.625 inches. For economy of manufacture valve body 38 and other parts of flow mode valve 32 may be molded of plastic, as shown in FIG. 5, or formed of aluminum or other suitable metals, as indicated in FIGS. 8–10.

Figure 2:
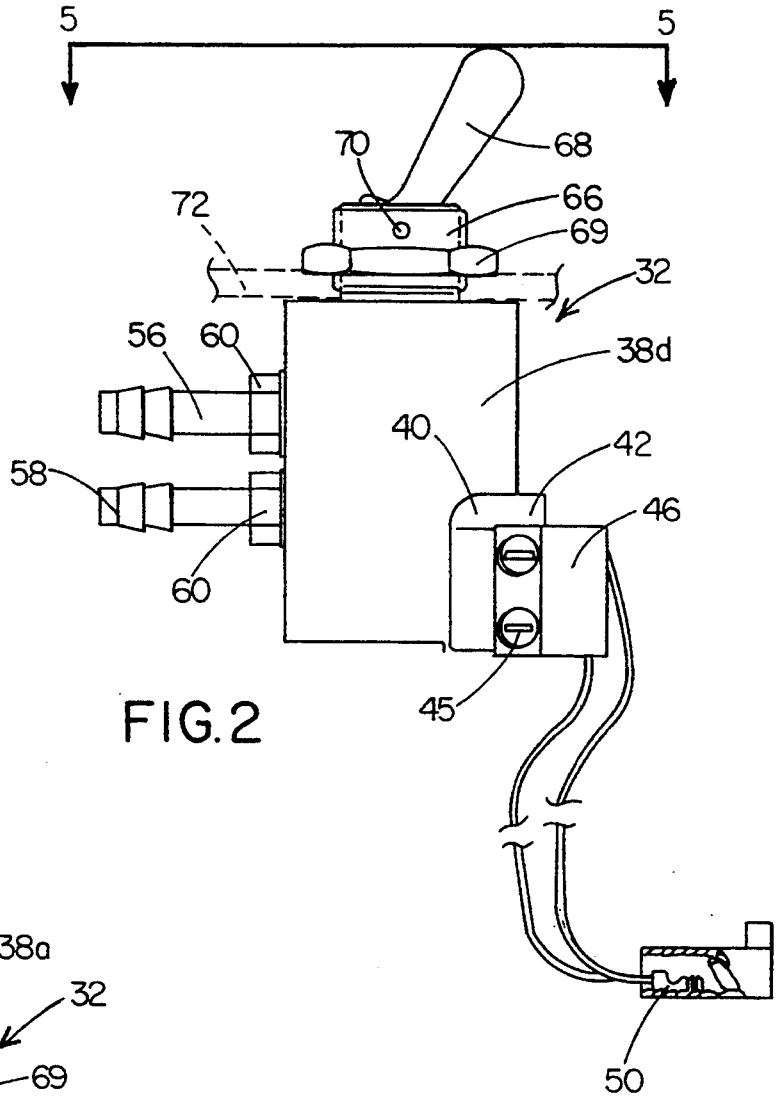
FIG. 2 is a rear elevational view of the flow mode control valve of the assembly of FIG. 1 and shown at the left side thereof.
Figure 3:
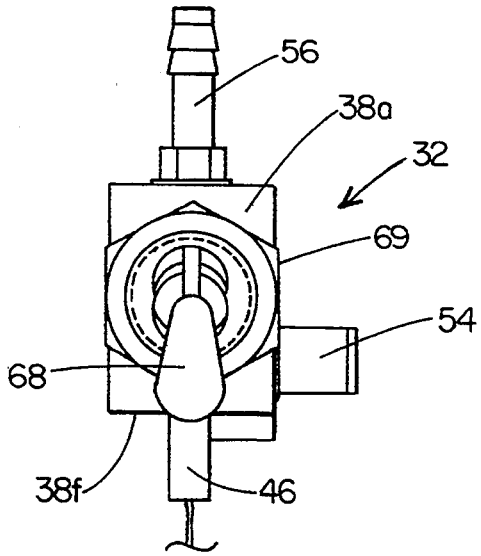
FIG. 3 is a top plan view of the flow mode control valve of FIG. 2, rotated 90 degrees.
Figure 4:
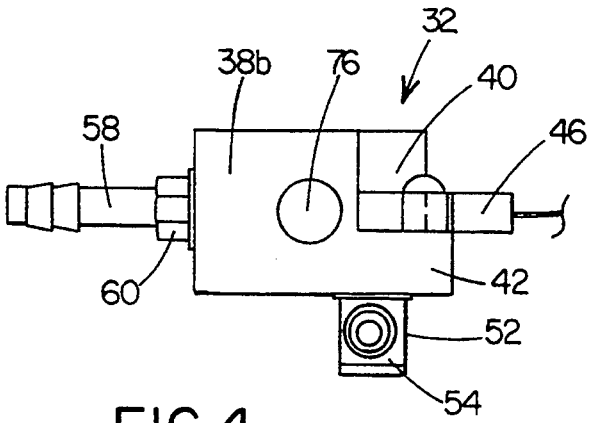
FIG. 4 is a bottom plan view of the flow mode control valve of FIG. 2.
Figure 6:
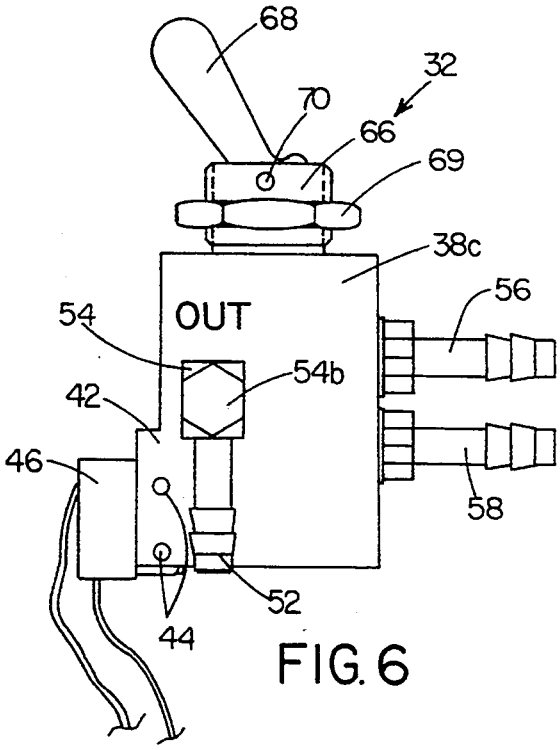
FIG. 6 is a rear elevational view of the valve of FIG. 2.

When in the upright position shown in FIG. 2, valve body 38 has an indentation 40 formed at the lower right corner of back wall 38*d*. Indentation 40 opens outwardly from wall 38*d* and back wall 38*f* and a flange 42 extends rearwardly therefrom. FIG. 6 shows the opposite side of valve 32 (the front thereof with reference to FIG. 1), where it is seen that extension or flange 42 preferably has formed apertures 44 for attachment by connectors such as brads or screws 45 of an electronic microswitch 46.

Microswitch 46 is of a readily available, known variety and serves to automatically sense and transfer information regarding the flow mode position of valve 32, preferably via coated wires 47 and electrical connector 50 to a known control monitor/panel assembly 48, which assembly includes an electronic pressure drop sensor, for example within line 57, and a known solenoid valve (not shown but, for example, positioned within line 64). The valve structure by which the position sensing occurs will be described hereafter with respect to the internal features of valve 32.

In this embodiment of flow mode control valve 32 an outlet nozzle 52 is connected to front wall 38*c* at mounting block 54. In this case nozzle 52 is directed downwardly, substantially parallel to wall 38*c*. Alternatively, depending upon constraints imposed by the particular use situation, nozzle 52 can be attached perpendicularly outwardly from mounting block 54 at a supplemental opening 54*a*, shown in FIG. 7 and sealed in this embodiment by a plug 54*b*. Of course other variations in the structure of the flow mode control valve outlet port can be conceived which would function appropriately.

As shown in this embodiment, outlet port nozzle 52 is connected by appropriate tubing 57 to any of a variety of appropriate known adaptors 59 for use by the patient, as indicated schematically in FIG. 1.

Preferably paired fluid inlet nozzles 56, 58 are connected in the usual manner by nut and washer assemblies, or hex nut and gasket assemblies 60 to valve body 38. In this embodiment nozzles 56, 58 are connected to wall 38*e* and extend parallel to one another directly and perpendicularly outwardly from body 38. Inlet nozzle 56 serves to allow passage of a continuous flow of fluid including oxygen into flow mode control valve 32 when it is set in a manner to be described in the continuous flow mode.

Figure 7:
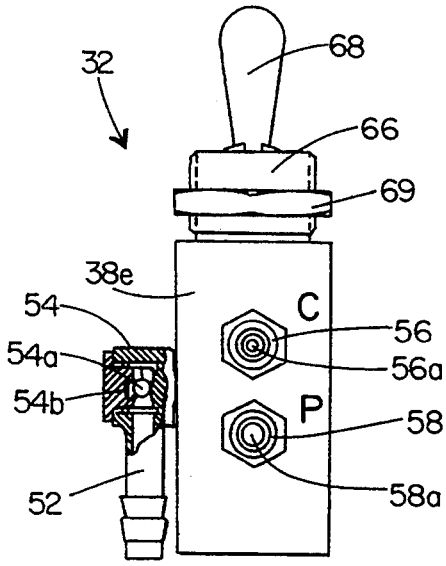
FIG. 7 is a left side elevational view of the flow mode control valve of FIG. 2.

FIG. 7 illustrates that the position of nozzle 56 is preferably marked on body wall 38*e* with a "C" (for "continuous") or some other designation to indicate the correct site of connection of fluid line 62 (FIG. 1) from rate control valve 34 for use of assembly 30 in the continuous oxygen supply mode. Similarly, nozzle 58 is shown to be connected to body 38 at a site which is desirably marked "P" to clearly indicate to the user the location of attachment of fluid line 64 from flow rate control valve 34 for provision of a larger volume of pulsed oxygen flow.

Nozzle 56 is also provided with a bore 56*a*, which is seen in the figures and is preferred to be smaller than a corresponding bore 58*a* of nozzle 58. This difference in inlet bore size is due to the previously discussed difference in volume of fluid taken into valve 32 through the appropriate inlet, depending upon the mode in which the valve is chosen.

Flow mode valve 32 is preferably provided on top wall 38*a* with an integral, upstanding, externally threaded neck 66 which serves as a site for connecting a switch 68 by a pin 70. Switch 68 is preferably of the toggle type, but as with certain other valve structural features (such as nozzles and connections therefor), may be of other known varieties and still function adequately, as will be seen.

Valve neck 66 is also provided with a correspondingly threaded nut 69 which attaches thereover and is useful in connecting flow mode valve 32 to a structural component, such as a compartment shelf or other flat surface, as indicated in phantom at 72, in order to stabilize this portion of assembly 30, for example, for transporting in a carrying case or affixing to a countertop.

Toggle switch 68 is connected to and selectively used to manually operate the internal structure of flow mode valve 32 which is seen in FIGS. 5 and 8–10. In these figures it is clearly seen that valve body 38 has a disposed longitudinal bore 74 formed substantially centrally therein and which bore preferably extends entirely from the open edge of neck 66 to and through bottom wall 38*b*.

Bore 74 serves to house an elongated spool-like valve shaft 76 which is pivotally connected at its upper end to toggle switch 68 by a pinned link 77 so that as switch 68 is moved, either manually or otherwise, from one position to another the shaft is caused to move longitudinally within the bore to thereby switch the valve from one flow mode (continuous or pulse) to the other. This flow mode switching is accomplished in a manner to be described more fully hereafter, in part by the provision of a series of three O-rings 78, 80, 82 which are spacedly disposed along the length of shaft 76. Shaft 76 has a diameter that varies from place to place along its length, for purposes to be described later herein.

The base 76*a* of shaft 76 is sized and shaped to fill the entire cross section of bore 74 and move longitudinally and slideably therein, but a substantial portion of the length of the shaft is much smaller in diameter than the bore so that fluid can be accommodated within the bore around the shaft. At each position on shaft 76 where one of the O-rings 78, 80, 82 is mounted the shaft is sufficiently wider than at the intervening portions, so that the O-rings are forced into snug but sliding contact with the inside annular wall of bore 74.

O-rings 78, 80, 82 are preferably formed of silicone or some other similarly durable material and can be additionally provided with a sealant of suitable type and quality to ensure a tight but slidable seal between each O-ring and the annular inside wall defining bore 74. The O-rings are spaced apart on shaft 76 to such extent that, when switch 68 and linked shaft 76 are in the positions shown in FIG. 5, O-ring 78 is positioned above the intersection of bore 74 with a transverse bore 84 to which fluid inlet nozzle 56 connects.

Simultaneously, when O-ring 78 is in the above-described position, O-ring 80 is disposed beneath the intersection of bore 84 and above a transverse bore 86 which intersects longitudinal bore 74 and serves as the site of attachment of pulsed fluid inlet nozzle 58. Also, when shaft 76 is in the above-described position O-ring 82 is disposed in shaft 74 below the intersection of transverse inlet bore 86. Still another transverse bore 88 intersects shaft bore 76 and provides a point of connection thereto of outlet nozzle 52.

Outlet bore 88 intersects and opens inwardly to bore 74 at a point indicated at "Z" in FIGS. 8, 9 and 10, and has a diameter at the point of such intersection which is greater than the thickness of O-ring 80. So sized, an important feature is provided to valve 32 in that it is impossible for O-ring 80 to entirely block fluid access to the outlet bore 88 when O-ring 80 is disposed directly adjacent to the opening of bore 80 into longitudinal bore 74. Thus, as will be described further hereafter, a fail-safe feature is provided by which fluid can pass through valve 32 to patient line 57 regardless of the position of switch 68.

Transverse outlet bore 88 is formed in body 38 through wall **38*f* at a point opposite to and approximately midway longitudinally between the positions of inlet bores 84, 86 but perpendicularly thereto. In the embodiment shown, the normal outward opening of bore 88 in wall 38*f* is blocked by a plug 88*a* and the bore is diverted perpendicularly to open through wall 38*c* where outlet nozzle 52 is connected thereto. Clearly, if desired, the original opening in wall 38*f*** could be used as the point of attachment of the outlet nozzle.

With transverse inlet and outlet bores 84, 86, 88 formed as described and O-rings 78, 80, 82 disposed on shaft 76 as described, it is possible by longitudinal movement of shaft 76 to reposition the O-rings relative to the bores and thereby determine the path of fluid flow through flow mode valve 32. O-rings 78, 82, due to their respective sizes and positioning, at all times prevent fluid leakage from around shaft 76 at each of the two opposed ends of bore 74. This feature is ensured by the optional provision of a lubricant, such as KRYTOX (registered trademark of E. I. DuPont DeNemours and Company) fluorinated grease on the O-rings. Thus, unnecessary fluid wastage, and possible inadvertent expiration of fluid supply are avoided.

FIGS. 8, 9 and 10 illustrate this feature most clearly by showing the relative positions of switch 68, shaft 76 and O-rings 78, 80 and 82 with respect to inlet bores 82, 84 and outlet bore 88 when valve 32 is set in the various optional flow modes.

FIG. 8 illustrates valve 32 set in the continuous flow mode with the various elements positioned as shown in FIG. 5, arrow A indicating the flow of incoming fluid through inlet nozzle 56. With switch 68 in the position shown in FIG. 8, and at all other times, O-ring 78 blocks longitudinal bore 74 above the intersection of transverse inlet bore 84 and below the lower end of link 77. Also in the FIG. 8 valve setting, continuous flow, O-ring 80 blocks the diameter of bore 74 beneath the intersection of transverse outlet bore 88.

With the various valve elements positioned as just described in the continuous flow mode, it is clearly seen that incoming fluid passes through nozzle 56, through bore 84, around shaft 76 within bore 74 and exits via bore 88 and attached nozzle 52.

FIG. 9 illustrates the fail-safe feature of valve 32. Switch 68 is shown in an upright position, incompletely toggled or switched so that shaft 76 and the O-rings thereon are in an intermediate position relative to the inlet and outlet bores of body 38. Nonetheless, fluid flow through valve 32 is not completely blocked because, as described previously, the thickness (depth) of O-ring 80 is not great enough to span the entire diameter of the opening at the intersection Y of transverse outlet bore 88 into longitudinal bore 74. Rather, fluid can flow from both above and below the level of O-ring 80, around it and outwardly through outlet bore 88 to nozzle 52.

FIG. 10 illustrates flow mode control valve 32 set in the pulsed fluid mode so that incoming fluid, indicated by arrow B, can pass through nozzle 58, through transverse inlet bore 86 to longitudinal bore 74, around shaft 76 above the position of O-ring 82, and beneath O-ring 80 before exiting via transverse outlet bore 88. As shown, O-ring 80 blocks longitudinal shaft bore 74 above the level of outlet bore 88 so that incoming fluid cannot escape by backflow into inlet bore 84 or through bore 74 as it passes through neck 66 around switch 68. At all times, with shaft 76 in any of the above positions, O-ring 82 completely seals the lower end of bore 74 so that fluid cannot escape from valve 32 at the lower end **76*a* of shaft 76**.

Thus it may be easily seen that by merely toggling switch 68 from one position to the other valve 32 may be quickly switched (usually, although not necessarily manually) from one flow mode to the other. If switch 68 is inadvertently left in the neutral position shown in FIG. 9 the patient can still receive oxygen which is able to flow around O-ring 80 through fluid outlet 88 without interruption in flow.

An additional fail-safe feature is shown in FIGS. 5 and 8–10 and consists of a detent mechanism, generally designated 90, which discourages shaft 76 from settling in the neutral position shown in FIG. 9. Detent mechanism 90 preferably consists of a small diameter, transverse bore 92 formed within valve body 38, for example, beneath and parallel to inlet bore 86. Detent bore 92 houses a small coil spring 94 which acts to bias a ball 96, disposed at the inner end of spring 94, inwardly toward shaft end **76*a* where there are formed, immediately adjacent to each other, upper and lower hemispherical depressions 98, 100, respectively, which are sized and shaped for rolling detenting receipt of ball 96 to thereby selectively movably retain shaft 76** in either of an extended (raised) or retracted (lowered) position.

As previously explained and shown in the figures, in the shaft-extended position, with switch 68 to the left (FIG. 10), valve 32 is set in the pulsed flow mode. Conversely, with shaft 76 in the retracted position switch 68 is set in the opposite direction (as shown in FIG. 8) and valve 32 is then in the continuous flow mode. FIG. 5 shown that a narrow, usually pointed projection 102 of shaft end 76*a* material is retained between detent hemispheres 98, 100 which discourages ball 96 from staying in a position therebetween and thus encourages shaft 76 to shift to be either fully raised or fully lowered if switch 68 should be left between the two mode positions.

The particular flow mode, continuous or pulse, in which valve 32 is selectively set is detected automatically by electronic sensing switch 46 which transmits such information to control panel 48 for monitoring and control. The interaction of switch 46 with shaft end 76*a* is illustrated in FIGS. 5 and 8–10. To accomplish this in the preferred manner another generally hemispherical depression 104 is formed in shaft end 76 for sliding receipt of a sensing button 46*a* on electronic sensing switch 46. When button 46*a* is in its outwardly projected position, as shown in FIGS. 5 and 8, a signal is sent to control mechanism 48 that valve 32 is recognized as being in the continuous flow position.

When valve 32 is set in the pulsed flow mode, as shown in FIG. 10, shaft 76 is fully raised, so that the annular wall thereof beneath depression 104 contacts button 46*a* and forces it into a fully depressed position, thereby signaling the pulse mode to the control unit 48.

In the embodiment described in part above the flow mode control valve 32 and flow rate control valve 34 are shown as interfacing but independent units connected by flow lines 62, 64, as seen in FIG. 1. Alternatively, the invention may take the form of the embodiment assembly 30', shown schematically in FIGS. 11–14, with the two types of valves for flow mode and rate control directly connected to one another in a single, combined unit, or module, without intervening tubing. If desired, a single housing may incorporate the elements of both valves.

Figure 12:
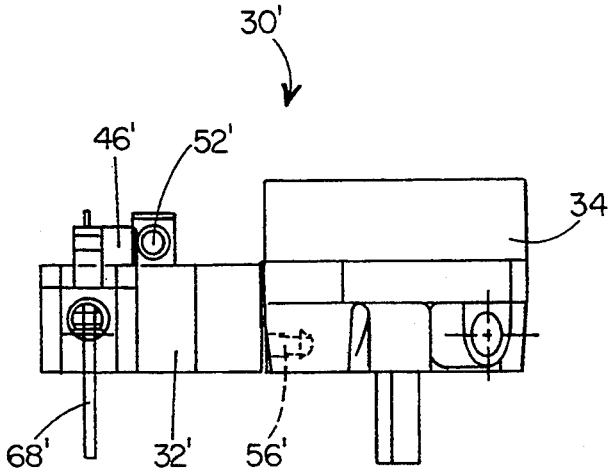
FIG. 12 is a top plan view of the valve of FIG. 11 directly attached to the flow rate control valve of FIG. 1, as a unitary device.
Figure 13:
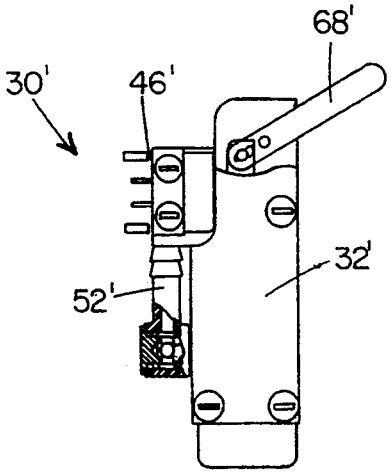
FIG. 13 is an elevational view of the valve of FIG. 11 showing the valve switch in the other of the continuous or pulse flow mode positions.
Figure 14:
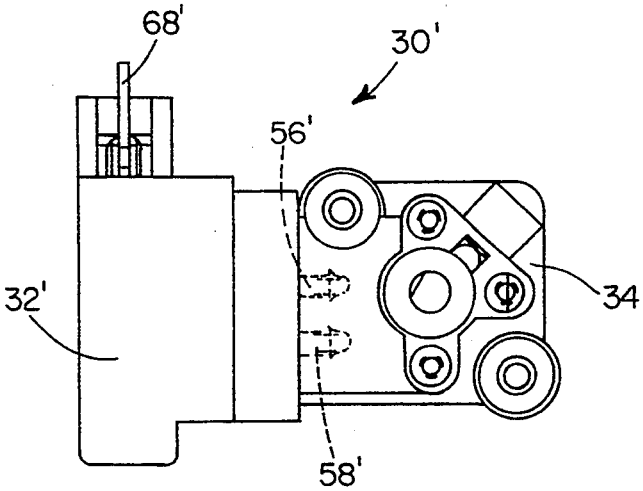
FIG. 14 is a side elevational view of the valve of FIG. 13 directly attached to the flow rate control valve of FIG. 1.
Figure 15:
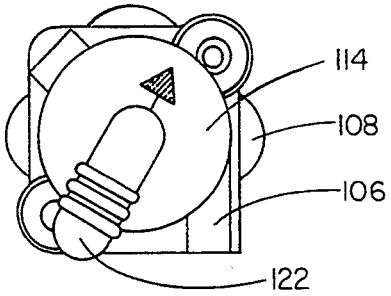
FIG. 15 is a top plan view of the flow rate control valve of the assembly of FIG. 1 and shown at the right side thereof.

In this alternative embodiment, which is included only by way of example, and not as a limitation, valve 34 is shown in FIGS. 12 and 14, for clarity, without the control knob, which will be described hereafter, but is otherwise the same as in assembly 30'. Also, an alternative to flow mode valve 32 is shown here as valve 32' and is generally similar to valve 32, but is provided with a lever-type handle 68', rather than toggle switch 68, for slidable switching rather than toggling. For simplification of the drawings some parts may be omitted from some views, but the internal valving and fail-safe features are the same.

In this embodiment the outlet ports of the rate control valve 34 (to be described in detail hereafter) are directly connected to the inlet nozzles of the mode control valve 56', 58' and thus, in normal functioning position, are substantially entirely received internally of valve 34. A patient fluid outlet nozzle 52' and microswitch 46', for position sensing, are provided which correspond generally in structure and function to those of valve 32.

The alternative valve assembly embodiment 30' just described provides the invention with additional flexibility of use by eliminating the need for interconnecting tubing which may be awkward, if not impossible, to accommodate in certain situations, such as when all portions of the assembly must be housed in a small carrying case.

The Multiple Flow Rate Control Valve

FIGS. 15 through 26 illustrate in detail the features of multiple flow rate control valve 34 which is an important part of the assembly in both embodiments described above, in that its unique structure permits interfacing use thereof with flow mode control valve 32, as shown in FIGS. 1 and 11–14, and to precisely control the rate of fluid flow to the mode control valve.

Flow rate control valve 34 has a body portion which is formed of two distinct parts consisting of what will be termed generally, for purposes of this discussion and with reference to the figures, upper body portion 106 and lower body portion 108, it being understood that although the connection and interrelationship of the two portions to each other will not change, the entire valve may be positioned during some usages so that it is upside-down, or side-ways, for example, relative to the position shown in the figures.

Preferably, valve 34 is formed of a very strong, thermoplastic, although other materials, such as some metals will suffice. As shown in the figures, both of the valve upper and lower body portions have generally irregular block shapes, excess material being removed so that the valve is as light as possible, being intended to be part of a portable assembly. However, body portions 106, 108 could of course be generally rectangular or oval in cross-section, for example, without affecting the functional aspects thereof, as will be clear from the following description.

Upper body portion 106 of valve 34 has a central through-bore 110 (FIGS. 22 and 23) for rotatably journalling a rotor shaft 112. From approximately the center of shaft 112 and extending continuously and longitudinally therealong to the upper or outer end 112*a* thereof is formed a flatted portion 112*b* which serves to key shaft 112 to a correspondingly flatted area 114*a* within the underside of a rotor control knob 114 as shown in FIG. 18.

Shaft 112 is provided, slightly above its lowermost end 112*c*, with a formed, annular groove 112*d* for seating of an O-ring 132 which is sized for gas-tight, rotatable sealing of shaft 112, substantially centrally and longitudinally within upper body portion 106. Shaft 112 is also shaped at its lowermost end 112*c* with preferably two opposed flat surfaces for keyed connection of the shaft to a rotor 134, the structure and function of which will be discussed further hereafter.

Knob 114 is formed and functions similarly to that described in U.S. Pat. No. 4,572,477, which is incorporated herein by reference. Accordingly, extremely detailed discussion of knob 114 will be avoided here.

Figure 18:
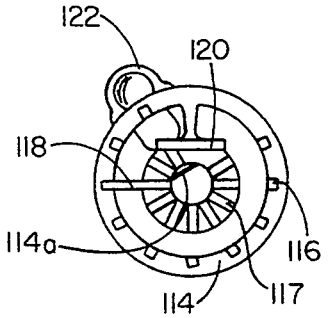
FIG. 18 is a bottom plan view taken on line 18—18 of FIG. 16.

However, it will be noted that knob 114 has an added, feature on the underside thereof, shown in FIG. 18. In addition to the radially paired, formed indentations 116, 117 which permit insertion of an elongated lock piece 118 for governing of the rotation of control knob 114, the knob also includes an integral storage site 120 for the locking piece when in an inactive condition.

Storage site 120 is essentially a formed groove which is sized for snug, friction fit retention of locking piece 118 during shipping, storage, or when otherwise not in use. Formed groove 120 is located inwardly of the thumb contact extension 122 which is seen to extend outwardly, beyond the perimeter of knob 114. Thus, even when in its inactive mode, locking piece 118 is readily dispensed for use when desired for prescription flow limiting.

Figure 17:
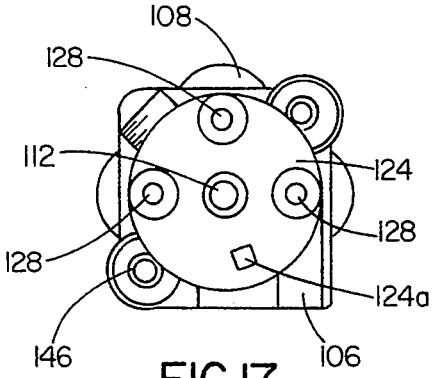
FIG. 17 is a top plan view taken on line 17—17 of FIG. 16.
Figure 16:
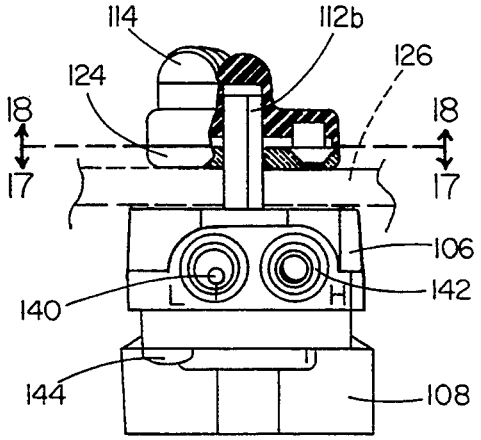
FIG. 16 is a front elevational view, partially broken away, of the valve of FIG. 15.

FIGS. 16 and 17 illustrate a stop plate 124 which is positioned beneath and coaxially in relation to control knob 114 and is centrally penetrated by rotor shaft 112. As shown in FIG. 16, stop plate 124 is disposed directly beneath knob 114 with the top of stop plate 124 juxtaposed in relation to the bottom of knob 114. So positioned, when knob 114 is rotated, with lock piece 118 in place, knob rotation is halted when the lock piece comes into abutting relationship with a small, integral, upward projection or "stop" 124*a* formed on stop plate 124. In this manner strict, fail-safe flow-limiting or flow-locking in accordance with a physician's prescription or instructions is attained.

Stop plate 124 is attached to a support surface 126 (shown in phantom in FIG. 16), for example by screws or other known connectors (not shown). Such connectors penetrate through-holes 128 in plate 124, and threadably connect to correspondingly threaded openings 130 formed in the top surface 106*a* of upper valve body portion 106 to preferably removably secure rate control valve 34 in normal use position. If valve 34 is formed of thermoplastic, rather than metal, it is preferred that openings 130 be lined and provided with such threads by insertion of internally threaded brass inserts for strength and durability.

Figure 23:
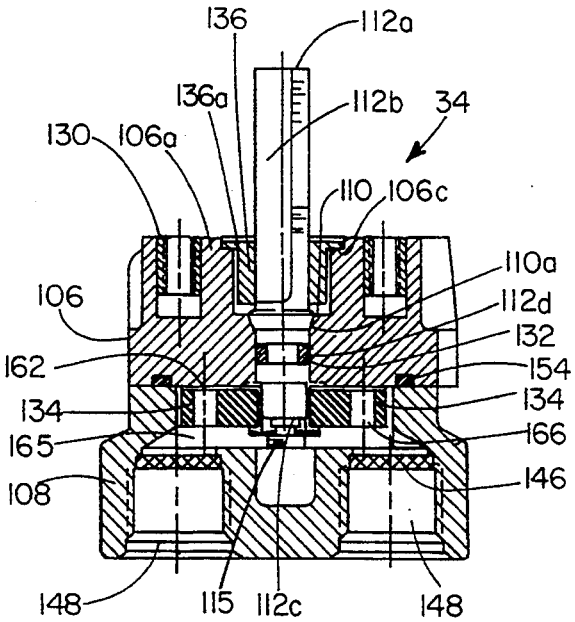
FIG. 23 is a vertical sectional view taken on line 23—23 of FIG. 22.

With reference to FIG. 23, directly beneath stop plate 124 at the top of bore 110 there is provided a detent bearing 136 which is centrally penetrated by shaft 112 and keyed thereto via formed flatted portion 112*b*. An outwardly extending flange is formed at the uppermost end of bearing 136 and rests upon a correspondingly sized annular ledge or seat 106*c* which is formed in top surface 106*a* at the opening there of bore 110. Bearing 136 is structured and functions as a detent in much the same as that described in U.S. Pat. No. 4,643,215, which is incorporated herein by reference.

Figure 19:
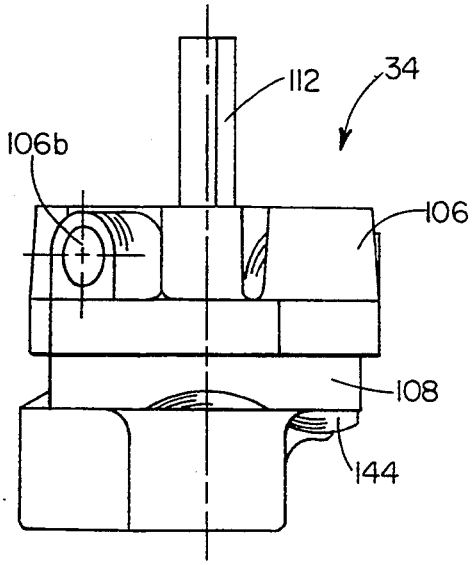
FIG. 19 is a side elevational view of the valve of FIG. 16 without the control knob and stop plate.
Figure 24:
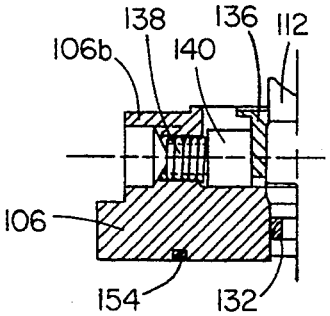
FIG. 24 is a vertical sectional view taken on line 24—24 of FIG. 22.
Figure 22:
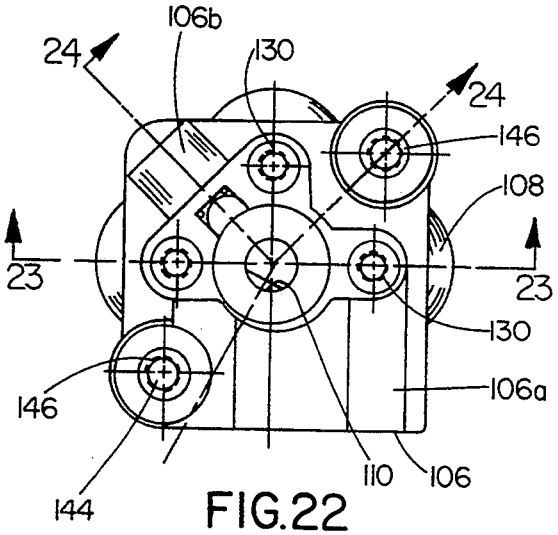
FIG. 22 is a top plan view of the valve of FIG. 20.

FIGS. 19, 22, and 24 show a housing 106*b* formed in upper body portion 106 for containing a spring 138 (maintained in position longitudinally therein by a set screw, not shown), which urges a modified detent or pawl 140 centrally toward bearing 136 and biases the pawl into indentations (not shown) around the periphery of bearing 136.

Thus, as knob 114 of flow rate control valve 34 is rotatably manipulated shaft 112 and bearing 136, which is keyed thereto, likewise rotate progressively through the detented positions until the desired knob position, corresponding to a desired fluid flow rate, is reached. The detent mechanism thereafter acts to retain multiple flow rate valve 34 in the preselected flow rate position.

Directly beneath the lower extreme of detent bearing 136 an annular shoulder 110*a* is formed in the interior wall of body portion 106 which defines bore 110. Shoulder 110*a* angles upwardly and outwardly from the central longitudinal axis of bore 110 and serves as a rotatable seat for an annular, angled flange 112*e* on shaft 112. The above-described sealing O-ring 112*d* is disposed around shaft 112 slightly below the position of flange 112*e*.

Figure 20:
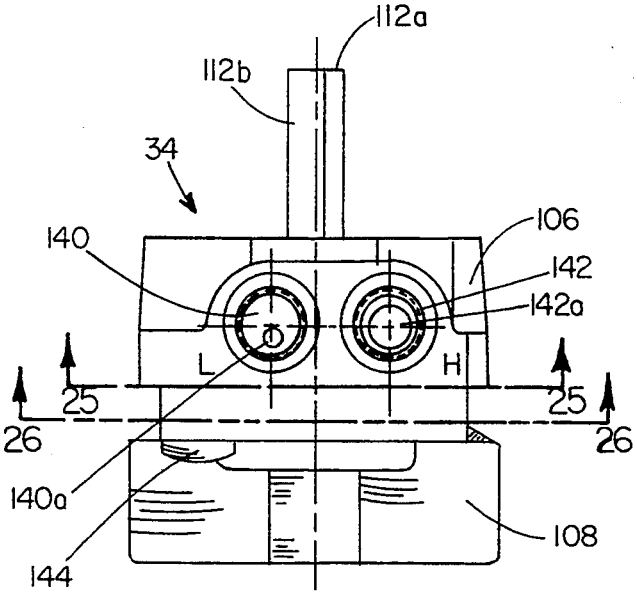
FIG. 20 is another side elevational view of the valve of FIG. 16, i.e., the valve of FIG. 19 rotated 90 degrees.

With reference to FIGS. 16 and 20, it is seen that dual fluid outlets 140, 142 are formed side-by-side, transversely within upper body portion 106 and are provided with relatively small and large diameter bores, respectively. Relatively low and high volume flows of fluid can thus be provided from rate control valve 34 via lines 62, 64, respectively, which are connected thereto by appropriate, known connectors 62*a*, 64*a*. The fluid is thus passed to inlet nozzles 56, 58 of flow mode control valve 32 at a preselected rate.

In other words, relatively low volumes of fluid pass from outlet 140 of rate control valve 34 to inlet 56 of mode control valve 32, and relatively high volumes of fluid are passed from outlet 142 of rate control valve 34 to inlet 58 of the flow mode control valve 32, so that in the continuous mode lower volumes are received by valve 32 than in the pulsed mode (higher volumes being necessary if supply is only available for a short burst of time).

Figure 21:
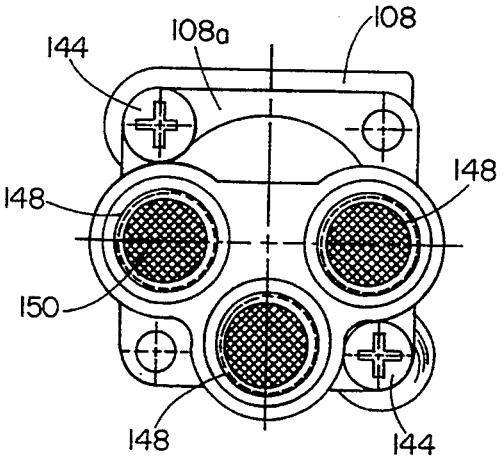
FIG. 21 is a bottom plan view of the valve of FIG. 20.

FIG. 21 shows diagonally positioned screws 144 which pass upwardly through the underside 108*a* of lower body portion 108 via appropriately sized and threaded through-holes (not shown) and threadably engage aligned apertures which penetrate upper body portion 106 to secure the upper surface (not seen) of lower body portion 108 to the lower surface 106*d* of upper body portion 106, thereby engaging the upper and lower body portions of the multiple flow rate control valve 34 as a functional unit.

FIG. 21 also illustrates a plurality of fluid inlets 148 for provision of incoming fluid to rate control valve 34 and which are desirably internally threaded for securement to pressurized fluid lines from source 36. Each inlet 148 has a sintered brass screen 150 disposed therein to filter incoming fluid in the usual manner. Preferably, at least two such inlets are provided, one for connecting a fluid source, and one for connection to a pressure relief device 152 of known variety (FIG. 1).

Figure 25:
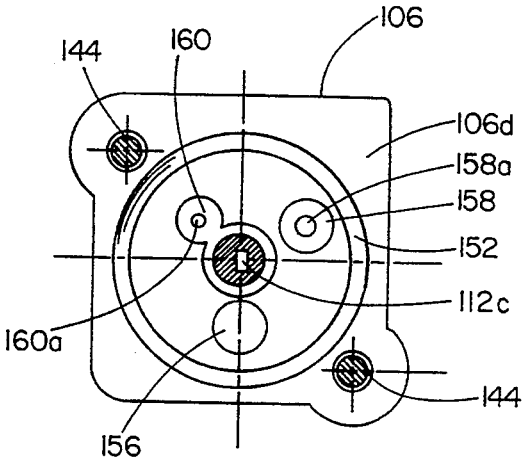
FIG. 25 is a bottom plan view taken on line 25—25 of FIG. 20.

FIGS. 23–25 show that an annular groove 152 formed in the lower surface 106*b* of upper body portion 106 retains an O-ring 154 which may optionally by supplemented by lubricating grease to form a seal between the facing surfaces of upper and lower body portions 106, 108, respectively.

FIG. 25 illustrates three small circular depressions 156, 158, 160 formed in the lower surface 106*d* inside of annular groove 152. Each depression 156, 158, 160 seats a small O-ring (not shown). The O-rings within depressions 158, 160 are provided in part for additional gas-tight sealing of valve 34, and the O-ring within depression 156 is sized the same and provides a third point, forming a level plane against which a thin stainless steel flow plate or disk 162 is supportedly pressed from beneath by the relatively thick, preferably plastic wafer-like support disk or rotor 134, as shown in FIG. 23.

Figure 26:
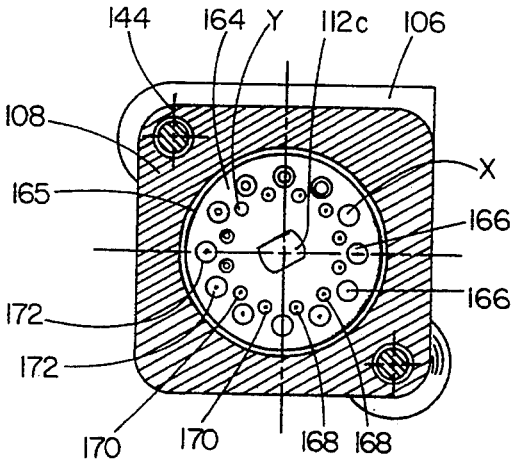
FIG. 26 is a bottom plan view taken on line 26—26 of FIG. 20.

In FIG. 26, there is seen the outer extent of a well like circular depression 165 formed in lower body portion 108 and within which rotor 134 is rotatably received for support thereon of apertured flow plate 162. This depression 165 is shown in vertical section in FIG. 23, where it is shown to preferably flare outwardly so as to have an annular skirt shape which encompasses the internal extent of fluid inlets 148.

FIG. 23 shows that rotor 134, which supports flow plate 162, is itself supported in position on shaft base 112*c* by known means, such as crescent washer 113, which is secured to shaft 112 in the usual manner, for example, by a preferably steel drive screw 115 which longitudinally penetrates shaft end 112*c*.

Substantially centrally within depressions 158, 160 are formed openings 158*a*, 160*a*, respectively within upper body portion 106 which connect internally of upper body portion 106 to high flow rate outlet bore 142*a* and low flow outlet bore 140*a*, respectively. As is illustrated in FIG. 25, opening 160*a* has a substantially smaller diameter than opening 158*a*, and is positioned more centrally relative to the longitudinal axis of rotor shaft 112, the keyed end 112*c* of which is seen substantially centrally within annular groove 152.

FIG. 26 illustrates that the thick plastic support rotor 134 is provided with two concentric rings of through-holes, the holes 166 of the outermost ring being significantly larger than those 168 of the inner ring, but all holes of a given ring preferably being like-sized for economy of manufacture.

It may be seen by comparison of FIGS. 25 and 26 and considering their respective positions with relation to FIG. 20, that the outer ring of larger holes 166 in flow-plate support rotor 134 are spaced radially outwardly from the central longitudinal axis of shaft 112 to the same distance as high volume flow bore 158*a* in upper body portion 106. Similarly, the inner ring of smaller holes 168 are positioned radially outward from shaft 112 to the same extent as low volume flow opening 160*a* in upper body portion 106.

Although the through-holes of each concentric ring in rotor 134 are identically sized per ring, openings formed in concentric rings of stainless steel flow plate 162 are arranged in graduated sizes, the relatively smaller openings making up the inner ring and the relatively larger openings arranged by gradations in an outer ring. The relative positions of flow plate 162 and supporting rotor 134 are radially aligned so that a particular flow plate aperture is aligned with a particular support rotor opening by similarly keying both elements to the lowermost tip 112*c* of rotor shaft 112. Thus rotation of shaft 112 will cause identical and simultaneous rotation of both rotor 1 and flow plate 162 supported thereon.

The graduated openings of the concentric inner and outer rings 170, 172 of flow plate apertures are seen in FIG. 26, one flow plate opening being positioned centrally within each single through-hole of rotor 134, with the exception of the openings indicated at "X" and "Y". Position "X" indicates the "Off" position of the rotor and flow plate with regard to track 172 (the larger sized apertures for high volume flow), there being no opening at all at "X" for passage therethrough of fluid. Similarly, position "Y" indicates the "Off" position for the inner track 168 of smaller flow plate apertures.

The metal rate control flow plate 162 is formed and functions to some extent similarly to that described in the above-mentioned U.S. Pat. Nos. 4,572,477 and 4,643,215. However, it is uniquely provided with dual, concentric rings of apertures of graduated sizes, rather than just a single ring or track of apertures. Preferably, each ring has 12 aperture positions, one of which is blocked and the remaining 11 being open.

Although some overlap in sizes may occur between the rings, generally, the apertures of inner track 170 have a range of diameters which is smaller than the range of diameters of the apertures of the outer track 172. For example, the apertures of inner track or ring 170 (low flow port) may vary in size so as to permit flow through of gaseous oxygen at rates of from 0.25 +/− 0.05 to 6.00 +/− 0.60 slpm, and the apertures of the outer ring 172 (high flow port) may vary in size so as to permit flow through of gaseous oxygen, for example, at rates of from 0.50 +/− 0.10 to 35.00 +/− 3.50 slpm when provided with an inlet pressure of 20.0 +/− 0.1 psig at 70 degrees Fahrenheit. Thus, by the alignment of the apertures of tracks 170, 172 with the inner and outer rings respectively, of openings 166, 168 in support rotor 134, by manipulation of knob 114 and rotation thereby of shaft 112, a particular aperture can be selected to provide fluid flow at a rate which is appropriate for the particular patient, use and flow mode setting of valve 32.

The above description is related for the most part to use of the new multiple flow rate control assembly 30, 30′ for metered delivery of oxygen to a patient by supplying oxygen at a precisely controlled rate via valve 34 to and through mode control valve 32. Other possible uses of the invention in this general manner have also been mentioned, such as for research and industrial purposes where carefully metered delivery of a fluid is required. Another alternative use of assembly 30 is in a reverse flow mode, for finely controlled combination of two fluids to produce a final fluid with a precisely calibrated concentration of the two original fluids.

As an example of the above, two different gases, such as oxygen and acetylene are separately introduced into rate control valve 34 via paired outlets 62*a*, 64*a*, rather than via the usual inlet 148. The specific amounts of each of the two gases in the final mixture is controlled via rotation of knob 114 in the described manner to cause alignment of the appropriately sized aperture of either track 170, 172, to permit flow through valve 34 of each of the two gases at the respective, desired rates. The outflow from rate control valve 34 can be passed to valve 32 via a single opening and attached tube, which may be bifurcated if necessary after the point of departure from valve 34 for simultaneous connection to the inlets 56, 58 of valve 32.

If necessary, for the above alternative use, flow plate 162 may have two concentric tracks of apertures of graduated size in which the range and selection of sizes are identical, as between the two sets, rather than as previously described, with the apertures of track 170 being of smaller diameter than the apertures of track 172.

Similarly, for particular applications, it may be desirable and is certainly possible to reverse the order or position of the two rings 170, 172 in flow plate 162, as well as the rings 166, 168 of through-holes in support rotor 134.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A multiple flow rate fluid control valve assembly in which the mode of fluid flow is interfaced with the rate of fluid flow, the assembly comprising:

a first valve having a plurality of selectable flow modes including a continuous fluid flow mode and a pulse fluid flow mode, and a switch for selectively setting the valve to one of the plurality of selectable flow modes, and a second valve connected to the first valve having structure to permit selectively controlling the rate of fluid flow from a source of fluid through the second valve to the first valve, thereby to provide fluid from the source of fluid to the first valve at a rate which is appropriate for the mode of fluid delivery selected and the particular fluid use.

2. The assembly of claim 1, wherein the first valve further comprises a sensor for automatically sensing the flow mode in which the first valve is set.

3. The assembly of claim 2, wherein the sensor is an electric micro switch incorporated into the body of the first valve.

4. The assembly of claim 1, wherein the first valve further comprises a shaft connected to the switch in such manner that the shaft is caused to be moved within the valve when the switch is moved to thereby cause the flow mode of the first valve to be changed from any one of the modes to another.

5. The assembly of claim 4, wherein the shaft has a depression formed therein, and the first valve further comprises a sensor for automatically sensing the flow mode in which the first valve is set, the sensor contacting the shaft at a point immediately adjacent the depression when the shaft is in one flow mode position and being removed from contact with the shaft when the first valve is switched to another flow mode position due to longitudinal movement of the shaft within the bore until the depression formed in the shaft comes into alignment with the sensor.

6. The assembly of claim 1, wherein the first valve is adapted for receipt of a greater flow of fluid volume from the second valve when the first valve is set in the pulse flow mode than when the first valve is set in the constant flow mode.

7. The assembly of claim 6, wherein the first valve has at least two fluid inlet ports, at least one of which has a larger diameter than the others-so as to be capable of receiving a greater flow of fluid from the second valve when the first valve is set in the pulse flow mode.

8. The assembly of claim 1, wherein the switch of the first valve is a toggle switch.

9. The assembly of claim 1, wherein the first valve and the second valve are indirectly connected to each other by tubing to thereby pass fluid at a metered rate from the second valve to the first valve.

10. The assembly of claim 1, wherein the first valve and the second valve are directly connected to one another as a unit, without the presence of any intervening tubing.

11. A multiple flow rate fluid control valve assembly in which the mode of fluid flow is interfaced with the rate of fluid flow, the assembly comprising:

a first valve having a switch for selectively setting the valve to one of a plurality of selectable flow modes, and a second valve connected to the first valve for selectively controlling the rate of fluid flow from a source of fluid through the second valve to the first valve, thereby to provide fluid from the source of fluid to the first valve at a rate which is appropriate for the mode of fluid delivery and the particular fluid use, wherein the first valve further comprises a shaft connected to the switch in such manner that the shaft is caused to be moved within the valve when the switch is moved to thereby cause the flow mode of the first valve to be changed from any one of the modes to another, and further wherein the first valve has a body which defines at least two inlet ports and at least one outlet port, the inlet ports being disposed one above the other on the body, and the at least one outlet port being disposed substantially perpendicular to the inlet ports at a position longitudinally substantially equally between the at least two inlet ports.

12. The assembly of claim 11, wherein the body of the first valve has a bore formed longitudinally therein and the shaft has two opposed ends and is disposed slideably longitudinally within the bore and is adjustably connected at one of the two opposed ends to the switch so that selective setting of the switch causes a change in the longitudinal position of the shaft within the bore.

13. The assembly of claim 12, and further wherein the shaft is provided with a plurality of O-rings mounted thereon spacedly along the length thereof in slidable, sealing contact with an inside wall of the bore in the body of the first valve and are longitudinally positioned so that when the switch is in a first position the O-rings are disposed so as to permit fluid flow from a certain one of the at least two inlet ports to the at least one outlet port, and when the switch is in a second position the O-rings are disposed so as to permit fluid flow from another certain one of the at least two inlet ports to the at least one outlet port, the O-rings being so sized and spaced on the shaft that a fluid tight seal is formed between the bore and the outside of the first valve, and that regardless of the respective positions of the switch and the shaft, fluid can always flow from one or more of the at least two inlet ports to the at least one outlet port, to thereby provide a fail-safe mechanism for the first valve.

14. A multiple flow rate fluid control valve assembly in which the mode of fluid flow is interfaced with the rate of fluid flow, the assembly comprising:

a first valve having a switch for selectively setting the valve to one of a plurality of selectable flow modes, and a second valve connected to the first valve for selectively controlling the rate of fluid flow from a source of fluid through the second valve to the first valve, thereby to provide fluid from the source of fluid to the first valve at a rate which is appropriate for the mode of fluid delivery and the particular fluid use, wherein the second valve is a flow rate control valve having an upper body portion and a lower body portion connected to the upper body portion, and a flow control plate rotatably mounted between the upper body portion and the lower body portion, the flow control plate having a plurality of tracks of apertures of graduated size for selectively controlling the amount of fluid which can pass therethrough as the fluid is transferred from the second valve to the first valve.

15. The assembly of claim 14, wherein the plurality of tracks of apertures are formed as paired concentric rings of apertures of graduated size, the apertures of the outermost ring having diameters over a range which is greater than the diameter of any of the apertures in an innermost ring.

16. The assembly of claim 14, wherein the flow control plate is adapted for selective use of the second valve to provide fluid to the first valve at a predetermined flow rate which can be precisely controlled whether the first valve is in a continuous or a pulsed flow mode.

17. The assembly of claim 16, and further wherein the second valve is provided with a first fluid outlet and a second fluid outlet, the first fluid outlet having a larger diameter than the second fluid outlet, for easier passage therethrough of larger volumes of fluid at a faster rate than is possible with the second fluid outlet, the first fluid outlet being connected to one of the concentric circles of flow plate apertures and the second fluid outlet being connected to the other of the concentric circle of flow plate apertures, the apertures of the circle in connection with the first fluid outlet having diameters which are greater than the diameter of the largest of the apertures in the concentric circle thereof which is connected to the second fluid outlet.

18. The assembly of claim 17, wherein the first valve is provided with a first fluid inlet and a second fluid inlet, the first fluid inlet having a larger diameter opening than the second fluid inlet, the first fluid inlet being for provision of fluid to the first valve when it is in the pulse flow mode and the second fluid inlet being for provision of fluid to the first valve when it is in the continuous flow mode, and further wherein the first fluid outlet of the second valve is connected to first fluid inlet of the first valve and the second fluid outlet of the second valve is connected to the second fluid inlet of the first valve, thereby to provide greater volumes of fluid at a faster rate to the first valve when it is in the pulse flow mode and lower volumes of fluid to the first valve at a slower rate when it is in the continuous flow mode.

19. The assembly of claim 14, wherein the flow control plate is adapted for selective use of the second valve to provide fluid to the first valve at a predetermined flow rate which can be precisely controlled when the fluid is provided to the second valve from a fluid source at a predetermined pressure.

20. The assembly of claim 14, wherein the flow rate control valve has a control knob rotatably connected to the upper body portion, thereby to selectably adjust the rate at which fluid can flow through the flow rate control valve to the first valve.

21. The assembly of claim 20, wherein the control knob is provided with means for limiting the rotation thereof in order to prevent inadvertent fluid flow at a rate beyond that which has been pre-selected.

22. The assembly of claim 21, wherein the means for limiting rotation includes a removable locking piece and the control knob further includes an integral storage site for the removable locking piece so that the locking piece can be used selectively and stored in a position for ready access when not in use.

23. A multiple flow rate fluid control valve assembly in which the mode of fluid flow is interfaced with the rate of fluid flow, the assembly comprising:

first valve means having means for switching, for selectively setting the first valve means to a preselected one of a plurality of optional fluid flow modes, including a pulse fluid flow mode and a continuous fluid flow mode and second valve means connected to the first valve means and to a source of fluid for selectively controlling the rate of fluid flow from the source of fluid through the second valve means to the first valve means, thereby to provide fluid from the source of fluid to the first valve means at a rate which is appropriate for the mode of fluid delivery selected and the fluid use.

* * * * *